United States Patent [19]

Grayson

[11] 4,418,679

[45] Dec. 6, 1983

[54] CERAMIC WALL SPACER KIT

[76] Inventor: Roy N. Grayson, Aristo-mat, Inc., 1718 E. 75th St., Chicago, Ill. 60649

[21] Appl. No.: 156,672

[22] Filed: Jun. 5, 1980

[51] Int. Cl.[3] ..... F24C 15/36

[52] U.S. Cl. ..... 126/201; 126/279; 52/512; 52/713; 219/345; 237/79

[58] Field of Search ..... 126/201, 202, 279; 52/713, 512, 509, 508; 248/488; 110/336; 237/79, 76, 70; 219/345

[56] References Cited

U.S. PATENT DOCUMENTS

| | | | |
|---|---|---|---|
| 485,363 | 11/1892 | Andrianson | 126/201 |
| 1,970,054 | 8/1934 | Nordan | 126/201 |
| 3,742,670 | 7/1973 | Byrd, Jr. | 110/336 |
| 3,771,467 | 11/1973 | Sweet | 110/336 |
| 4,238,103 | 12/1980 | Kurtz | 248/488 |

FOREIGN PATENT DOCUMENTS

| | | | |
|---|---|---|---|
| 2031577 | 4/1980 | United Kingdom | 237/79 |

*Primary Examiner*—James C. Yeung

[57] ABSTRACT

A mounting kit for stove boards includes ceramic spacers separating the board from a wall so that cool air can circulate behind the board and spacing cradles supporting the board off the floor so air can additionally flow beneath the board. Mounting brackets touch only ceramic surfaces of the spacers so that there is no metallic conduction of heat into the wall.

3 Claims, 4 Drawing Figures

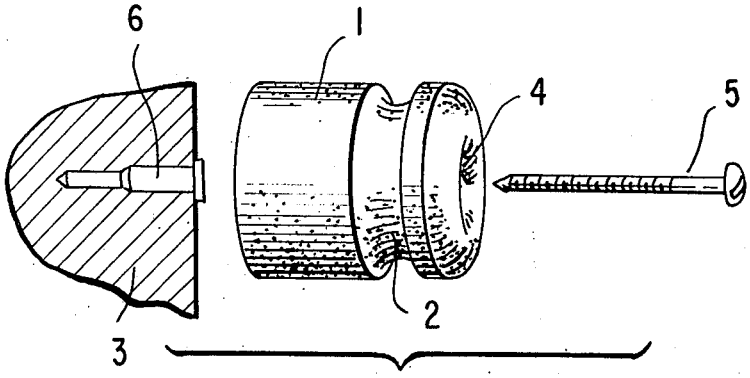
FIG. 1
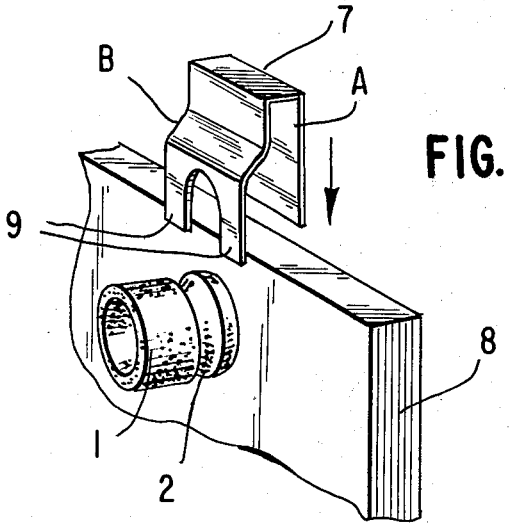
FIG. 2
FIG. 4
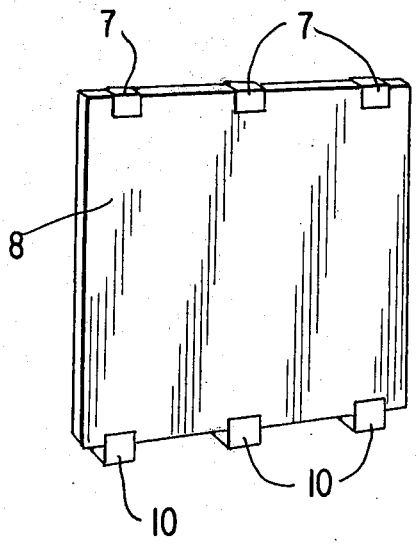
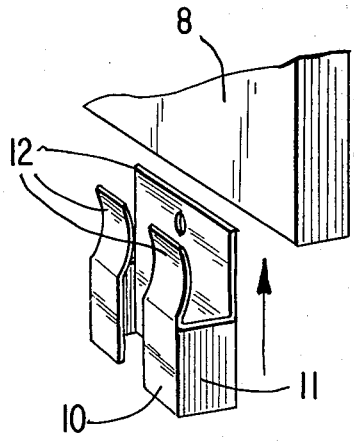
FIG. 3

CERAMIC WALL SPACER KIT

BACKGROUND OF THE INVENTION

This invention relates to stove boards, and more particularly to wall mounting of stove boards.

When a hot stove or fireplace heater must be located near a wall, it is advisable, or in most instances necessary, to interpose a nonflammable, insulating barrier between the source of heat and the wall, i.e., a stove board, to insure safety. Furthermore, it has been found desirable to position a stove board by means of ceramic spacers an inch or so from the wall so that cool air can circulate behind the board, thus providing an additional safety factor. While stove board mounting devices have in the past incorporated ceramic spacers to provide this air space between wall and board, heretofore there has not been a device that will additionally allow the board to be suspended from the floor—an important safety feature that allows cool air to pass between the floor and the board. Nor has it been possible in the past to mount the stove board in such a manner that heat transmission into the wall via metal fasteners is completely eliminated. A screw passing directly through the stove board into a wall can conduct a potentially dangerous amount of heat. A wooden joist, for example, may become charred with time. Other wall materials can also be degraded from this heat conduction. Furthermore, drilling mounting holes into the stove board, which is generally a composite of metal and mineral insulation, could be detrimental to the integrity of the mineral insulating layer.

SUMMARY OF THE INVENTION

The present invention is a kit for mounting a stove board parallel to a wall, with ceramic spacers between the wall and the board determining a space where air can circulate behind the board, and with cradles, or other suitable bottom spacers, under the board to provide for air flow beneath the board. The ceramic spacers are mounted directly to a wall by suitable means, and snap-on brackets, or other means, connect the stove board to the spacers.

It is an object of the present invention to provide a space beneath the stove board where cool air can circulate as a safety factor.

A further object of the invention is to eliminate any metal fasteners passing through the stove board directly into a wall that might conduct heat into the wall.

Yet another object of the invention is to eliminate the necessity of drilling mounting holes in the stove board itself.

In a further aspect, the present invention is a stove board assembly supported on spacers.

Further features and benefits of the present invention will be apparent from the following description with reference to the accompanying drawings.

BRIEF DESCRIPTION OF THE DRAWINGS

FIG. 1 is a perspective view of the ceramic spacer with a sectional view of a wall.

FIG. 2 is a perspective view of the ceramic spacer, mounting bracket, and a portion of the stove board.

FIG. 3 is a perspective view of the bottom cradle and a portion of the stove board.

FIG. 4 is a view from the front of the assembled stove board assembly.

DESCRIPTION OF THE PREFERRED EMBODIMENTS

Referring to FIG. 1, a ceramic spacer 1 having a groove 2 about its periphery in a plane parallel to the wall 3 and hole 4 through its body perpendicular to the wall is attached to the wall by means of screw 5. A screw anchor 6 may be necessary for plaster or dry wall mounting.

Referring to FIG. 2, metal bracket 7 includes a rectangular shaped channel section A that snaps down over the top of stove board 8 and a yoke section B with downward directed prongs 9 that engage groove 2 of the ceramic spacer, thus affixing the stove board to the spacer. Note that the bracket 7 touches only ceramic material so that there is no heat conduction through the board to the wall via metal fasteners. In accordance with the teachings of the present invention, any suitable means may be used to affix the board to the spacer provided that this means physically connects only ceramic surfaces of the spacer to the board. That is to say, metal fasteners should not be employed that would pass through both the board and spacer into the wall.

A distance of roughly one inch has been found to be an adequate separation of wall and stove board.

FIG. 3 shows a bottom cradle that supports stove board 8 off the floor so that air can circulate beneath. Cradle 10 includes a spacing portion 11 upon which the board rests an inch or more above the floor and finger sections 12 extending upward from the spacer section. The bottom of the board is gripped by these finger sections.

FIG. 4 shows what the assembled board looks like from the front. Cradles 10 support board 8 off the floor and brackets 7 affix the board to the wall.

I claim:

1. A ceramic wall spacer kit for mounting a stove board comprising:

at least one ceramic spacer separating the stove board from a wall, said spacer having about its periphery a groove;

means for mounting said spacer to a wall; and a bracket for affixing said spacer to the stove board, said bracket having two portions, one portion being a rectangular shaped channel that snaps down over the top of the stove board, and extending therefrom to the wall side, the other portion being a yoke having two downward directed prongs that engage the groove in the spacer, thus affixing the board to the spacer.

2. The kit of claim 1, further comprising means for supporting the stove board off the floor so that cool air can circulate beneath.

3. The kit of claim 2, wherein said supporting means comprises at least one cradle, said cradle having a spacing portion upon which the stove board rests, and extending upwards therefrom, finger sections between which the bottom edge of the board is held.

* * * * *